United States Patent [19]

Hugly

[11] 4,013,330

[45] Mar. 22, 1977

[54] DUAL-STANDARD ELECTRIC PLUG

[75] Inventor: Jean-Daniel Hugly, Yverdon, Switzerland

[73] Assignee: The Gillette Company, Boston, Mass.

[22] Filed: Nov. 17, 1975

[21] Appl. No.: 632,283

[30] Foreign Application Priority Data

Nov. 21, 1974 United Kingdom ..... 50534/74

[52] U.S. Cl. ..... 339/31 R; 339/31 M

[51] Int. Cl.[2] ..... H01R 29/00

[58] Field of Search ..... 339/31 R, 31 M, 32–34, 339/39

[56] References Cited

UNITED STATES PATENTS 2,450,657 10/1948 Guernsey ..... 339/31 M

FOREIGN PATENTS OR APPLICATIONS 240,724 1/1960 Australia ..... 339/31 M 603,326 3/1960 Italy ..... 339/31 M

*Primary Examiner*—Roy Lake

*Assistant Examiner*—E. F. Desmond

*Attorney, Agent, or Firm*—Flynn & Frishauf

[57] ABSTRACT

A dual-standard electrical plug comprising an insert carrying two different pairs of socket pins, said insert being insertable into a plug casing in either one of two orientations so that one pair of socket pins projects and the other pair is concealed.

19 Claims, 6 Drawing Figures

DUAL-STANDARD ELECTRIC PLUG

FIELD OF THE INVENTION

This invention relates to an electrical plug, and more particularly a dual-standard electrical plug which is adaptable to provide either a pair of socket pins dimensioned and/or positioned in accordance with one standard or a pair of socket pins differently dimensioned and/or positioned in accordance with another standard.

PRIOR ART

Various constructions of adaptable electrical plugs have been proposed. In particular, these known plugs are adaptable to enable them alternatively to fit sockets of differing types, such as three pin heavy-duty sockets and two-pin light-duty sockets or two pin light-duty sockets and bayonet-type (or screw-in type) lamp sockets. Some of these known constructions propose the use of a reversible insert having differing contact arrangements at their opposite ends, the insert being externally screw-threaded to screw reversibly into an internally screw-threaded casing into which passes the supply cable.

However, most of the known constructions originate from proposals made many years ago and constitute designs which are inadequate to meet present day electrical safety regulations. Consequently, the use of detachable converters has become commonplace, but these are disadvantageous in that they can easily be forgotten, mislaid or lost.

OBJECT OF THE INVENTION

An object of the present invention is to provide a dual-standard plug which can readily be constructed to meet present day safety requirements.

In particular, the present invention aims to provide a two pin plug adaptable to two differing standards, that is to say, the standards of two countries or two groups of countries, both in respect of the differing dimensions and/or relative positions of the pins and the differing electrical safety regulations which may be applicable in the various countries concerned. The plug is therefore intended, more particularly, for use in connecting the power supply from a light-duty socket to a portable appliance, such as a shaver, of the type which does not require a connection to earth or ground.

BRIEF SUMMARY OF THE INVENTION

According to the invention there is provided a dual-standard electrical plug comprising an insulating hollow casing having an opening, a terminal fitting within the casing, said fitting comprising a pair of conducting terminal pins extending towards the opening in the casing, an insulating insert insertable with a sliding action into the opening in the casing, said insert having apertures for receiving the terminal pins, respective pairs of conducting socket pins projecting from opposite faces of the insert, the socket pins of the respective pairs being adapted to differing standards in respect of their dimensions and/or relative positions, locking means for locking the insert in the casing with a selected pair of socket pins projecting therefrom and the other pair of socket pins accommodated in the casing, and means establishing a conductive connection between said selected pair of socket pins and the terminal pins received in the terminal pin-receiving apertures in the insert only when the insert is inserted into the casing.

The insert may be provided, for example, with one pair of pins conforming to the constructional requirements of a major part of the continent of Europe and one pair of pins conforming to the constructional requirements of the U.S.A. The plug can be made to conform with applicable safety requirements due to the provision of the locking means which prevents the casing of a plugged-in plug from being pulled away while leaving the insert plugged in. A further feature of a preferred arrangement, which will be described later, is the electrical isolation of one pair of socket pins from the other which is automatically effected when the casing is separated from the insert.

BRIEF DESCRIPTION OF DRAWINGS

A preferred practical embodiment of a dual-standard electrical plug and modification thereof in accordance with the invention will now be described by way of example with reference to the accompanying drawings, in which.

DESCRIPTION OF EMBODIMENTS

Figure 1:
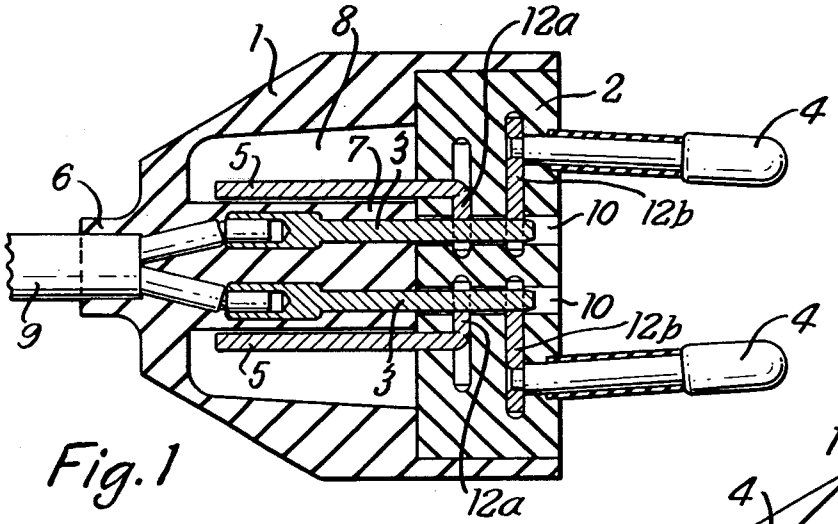
FIG. 1 is a section through the plug on the line X—X of FIG. 2.

The preferred embodiment of plug shown in the drawings comprises a separable hollow casing 1 and insert 2, both made of electrically insulating material.

Figure 2:
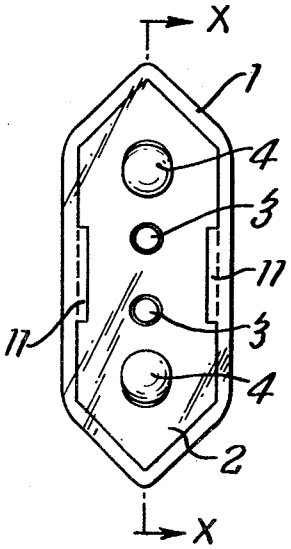
FIG. 2 is an end view of the plug.

As can be clearly seen from FIG. 2, the casing 1 is of a flat hexagonal form symmetrical about the axis of the plug. It is open at one end and tapers to a reduced cross-section at the other end. Referring to FIG. 1, this other end of the casing is integrally formed with an external axial apertured boss 6 and an internal axially extending terminal housing 7, leaving a free space 8 between said housing and the interior surface of the wall of the casing. A two conductor supply cable 9 enters the aperture in the external boss 6. The internal housing 7 holds two spaced-apart axially-extending terminal pins 3 to which the conductors of the supply cable are connected via holes which are formed in the internal housing in communication with the aperture in the external boss 6. The terminal pins 3 project from the free end face of the internally axially-extending housing towards the open end of the casing 1.

For certain small domestic appliances such as shavers, it is preferred for the casing unit, including the external boss 6 and internal terminal housing 7, to be moulded as an integral body incorporating the terminal pins 3 and having the end of the supply cable 9 bonded therewith as part of the moulded structure. Such a construction is shown in the drawings. However, the casing may alternatively be formed in two symmetrical parts which can be fastened together to secure the terminal pins in position, these pins being provided with axial holes and transverse grub screws which can be tightened to secure in position the conductors of a separate supply cable.

The insert 2 is of corresponding flat hexagonal form to fit slidably in the axial direction into the open end of the casing 1. The insert is of moulded construction incorporating two pairs of socket pins 4 and 5, respectively, as part of the integral structure. The respective pairs of pins project axially from opposite faces of the insert in opposite axial directions. One pair of pins may conveniently consist of round socket pins 4 conforming in their relative positions and dimensions to the European International Commission on Rules for the Approval of Electrical Equipment (CEE 7, Standard Sheet XVI) for 2.5 A 250 V Two-Pole Plug Class II Appliances, which includes electric shavers and many other domestic portable appliances. The other set of pins may conveniently consist of flat socket pins 5 conforming to the American Standard of Underwriters' Laboratories Inc. (U.L. Publication 498) for Two-Pole 2-Wire Devices rated 15 amperes, 125 Volts. Many small electrical appliances such as shavers incorporate voltage adaptation switching means to enable the appliances to be used with differing supply voltages.

Figure 3:
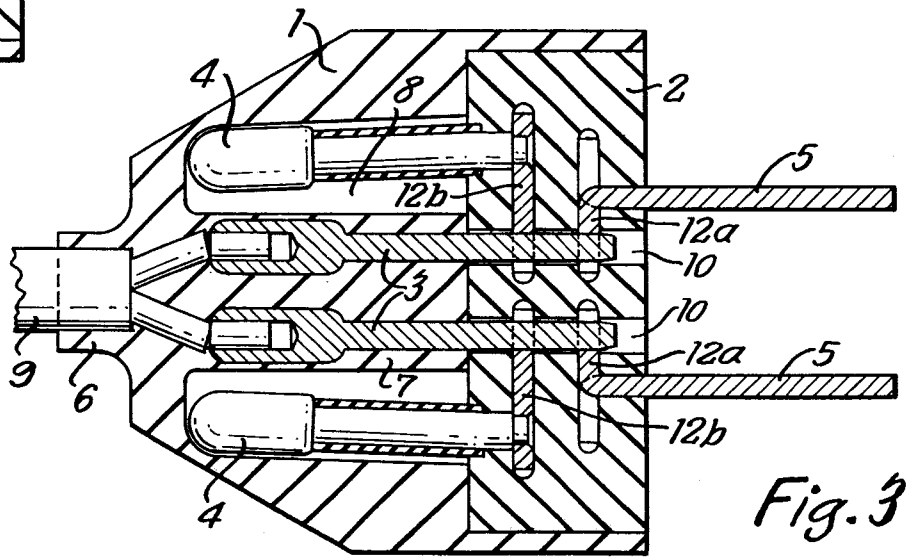
FIG. 3 is a view similar to that of FIG. 1 but slightly enlarged with the insert reversed.

The insert 2 can be pushed into the open end of the casing 1 with either one of the pairs of socket pins 4 or 5, projecting outwardly and the other pair projecting within the casing towards the tapered end thereof in the free space 8 surrounding the internal axially-extending terminal housing 7. FIG. 1 shows the plug with the socket pins 4 projecting therefrom and FIG. 3 shows the insert reversed with the socket pins 5 projecting. The corresponding hexagonal shapes of the casing 1 and insert 2 ensure that, when the insert is inserted, the ends of the terminal pins 3 projecting from the internal projection within the casing will be received in through-holes 10 formed in the appropriate location in the moulded body of the insert.

For effecting an electrical connection between the terminal pins 3 and the socket pins 4 and 5, the insert incorporates electrically conductive connecting elements 12*a*, 12*b* extending between the respective socket pins and the through-holes 10 in which the terminal pins 3 are received. The terminal pins 3 make electrical contact with these connecting elements 12*a*, 12*b* respectively, when the insert is pushed into the casing, whereby the socket pins 5, 4 are electrically connected to the terminal pins 3. It is important to note that the connecting elements 12*b* connected to the socket pins 4 are contained in a first transverse plane and the connecting elements 12*a* connected to the socket pins 5 are contained in a second transverse plane axially spaced from the first transverse plane, so that when the casing 1 and the insert 2 are separated there is no electrical connection between the socket pins 4 and the socket pins 5.

The interior surface of the wall of the casing 1 is stepped in a plane coplanar with the end face of the terminal housing 7 to provide a seating for the inserted insert, and in addition means are provided for locking the insert in its fully inserted position against said seating. This locking means takes the form of a pair of opposed internal lips 11 on the casing which snap resiliently into either pair of two pairs of corresponding recesses provided in the external surface of the insert adjacent the opposite axial end faces thereof. While it remains readily possible to remove the insert 2 from the casing 1 to effect reversal thereof by use of a suitable tool or by squeezing the casing or by exerting a strong pull on the outwardly projecting socket pins, so that the locking lips 11 are caused to yield, the locking means makes it substantially impossible to detach the casing from the insert of a plugged-in plug. Furthermore, even if the casing should by some mischance be detached from a plugged-in plug, the exposed pins of the insert which remains plugged-in will not be connected to the power supply because the removal of the terminal pins 3 electrically isolates the socket pins 5 from the socket pins 4. It will be appreciated that various other kinds of locking means can be used if desired, such as a screw-driven-openable locking bolt.

Figure 5:
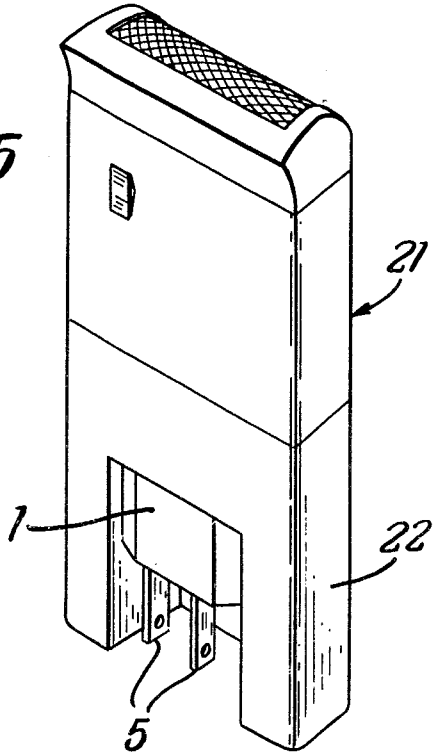
FIGS. 4 and 5 show an electric shaver/charger system incorporating the invention.
Figure 4:
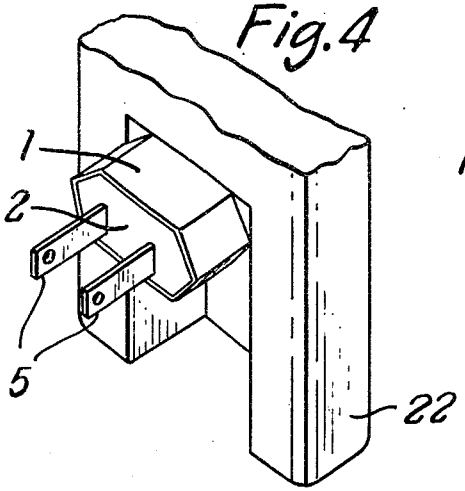

A modified arrangement is shown in FIGS. 4 and 5. In this modification, the terminal pins within the casing unit 1, instead of being connected to a supply cable, are connected directly to the internal wiring of the charger section 22 of an electric shaver/charger system 21. In other respects, the constructions of the casing unit 1 and insert 2 are identical to that shown in FIGS. 1 to 3. Conveniently, the casing unit 1 is mounted to pivot from the operative position shown in FIG. 4 to the inoperative position, convenient for storage when travelling, shown in FIG. 5, while maintaining the connection between the terminal pins and the internal wiring of the shaver/charger system.

Figure 6:
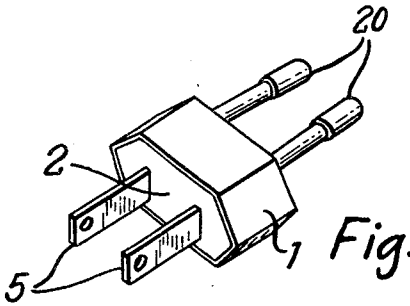
FIG. 6 is a perspective view of a modified plug, for example for use in a shaver/charger system.

A generally similar arrangement to that of FIGS. 4 and 5 can also be achieved by means of the modified plug shown in FIG. 6. The terminal pins within the casing unit 1 are connected to a pair of plug-in pins 20 fixedly projecting from the casing at the opposite end to the open end receiving the insert 2. The plug-in pins 20 are plugged directly into a socket provided in the charger section 22 of the electric shaver/charger system 21. For safety reasons, the plug-in pins 20 are normally sheathed by resiliently mounted insulating sleeves (not shown) which are retracted when the pins 20 are plugged into the charger socket. In addition, the dimensions and/or spacing of the pins 20, while fitting the charger socket, will be chosen so that these pins 20 cannot be entered into a mains supply socket. The selected pair of socket pins 4 or 5 project from the plug, in similar manner to FIG. 4, to enable the system to be plugged directly into the socket of a corresponding mains supply system for the purpose of charging the shaver battery. The modified plug may be stored in the shaver/charger system for the purpose of storage when travelling, in similar manner to FIG. 5.

It will be appreciated that various further modifications of the above-described dual-standard plug are possible within the scope of the invention. For example, the socket pins 4, 5 may be positioned and/or dimensioned to suit other standards, and a differently shaped casing and insert may then be employed if desired. Finally, it has already been mentioned that the casing 1 may be formed in separable parts, and in this case the terminal housing 7 may also be formed as a separate fitting from the casing.

I claim:

1. A dual-standard electrical plug comprising:

an insulating hollow casing having an opening, a terminal fitting within the casing, said fitting comprising a pair of conducting terminal pins extending towards the opening in the casing, an insulating insert insertable with a sliding action into the opening in the casing, said insert having apertures for receiving the terminal pins when said insert is received in the opening of the casing, respective pairs of conducting socket pins projecting from opposite faces of the insert, the socket pins of the respective pairs being insulated from each other when the insert is out of the casing and being adapted to differing standards in respect of their dimensions and relative positions, locking means for locking the insert in the casing with only one selected pin of each pair of socket pins projecting therefrom and the other socket pins accommodated in the casing, and connection establishing means in said insert for cooperative coupling with the terminal pins for establishing a conductive connection between said selected socket pins and the terminal pins received in the terminal pin-receiving apertures in the insert only when the insert is inserted into the casing.

2. A plug as claimed in claim 1, comprising a passage in the wall of the casing at a position remote from the insert-receiving opening through which a cable is passed for connection to the terminal fitting.

3. A plug as claimed in claim 1, wherein the terminal fitting is connected to the internal wiring of an electrical appliance on which the plug is mounted.

4. A plug as claimed in claim 1, including stop means in the casing for limiting insertion of the insert and defining the fully inserted position thereof.

5. A plug as claimed in claim 4, wherein the locking means comprises recess means in at least one of the casing and the insert, and projecting lip means on at least the other of the casing and insert for resiliently snapping into engagement with the recess means when the insert is inserted fully into the casing.

6. A plug as claimed in claim 1, wherein the internal cross-section of the opening in the casing and the external cross-section of the insert have the same non-circular shape selected to ensure that the terminals of the terminal fitting are received in the apertures in the insert when the insert is inserted into the casing.

7. A dual-standard electrical plug comprising:

an insulating hollow casing having an opening, a terminal fitting within the casing, said fitting comprising a pair of conducting terminal pins extending towards the opening in the casing, an insulating insert insertable with a sliding action into the opening in the casing, said insert having apertures for receiving the terminal pins when said insert is received in the opening of the casing, respective pairs of conducting socket pins projecting from opposite faces of the insert, the socket pins of the respective pairs being insulated from each other when the insert is out of the casing and being adapted to differing standards in respect of their dimensions and relative positions, locking means for locking the insert in the casing with only one selected pin of each pair of socket pins projecting therefrom and the other of said socket pins accommodated in the casing, and connection establishing means in said insert for cooperative coupling with the terminal pins for establishing a conductive connection between said selected socket pins and the terminal pins received in the terminal pin-receiving apertures in the insert only when the insert is inserted into the casing, said connection establishing means including means providing respective conductive connections between the terminal pins and two spaced positions along the terminal pin-receiving apertures in the insert, whereby the respective pins of each pair of socket pins are electrically isolated from each other when the insert is removed from the casing.

8. A plug as claimed in claim 7, wherein said means providing respective conductive connections comprises first connecting means embedded in the insert and electrically connected to a pin of each pair of socket pins, and second connecting means embedded in said insert and electrically connected to the other pin of each pair of socket pins, said first and second connecting means being spaced from each other along the terminal pin-receiving apertures in said insert and having respective apertures in alignment with the terminal pin-receiving apertures of said insert.

9. A plug as claimed in claim 7, comprising a passage in the wall of the casing at a position remote from the insert-receiving opening through which a cable is passed for connection to the terminal fitting.

10. A plug as claimed in claim 7, wherein the terminal fitting is connected to pin means adapted to plug directly into an electrical appliance, said pin means projecting externally from the casing at a position remote from the insert-receiving opening.

11. A plug as claimed in claim 7, wherein the terminal fitting is connected to the internal wiring of an electrical appliance on which the plug is mounted.

12. A plug as claimed in claim 7, including stop means in the casing for limiting insertion of the insert and defining the fully inserted position thereof.

13. A plug as claimed in claim 12, wherein the locking means comprises recess means in at least one of the casing and the insert, and projecting lip means on at least the other of the casing and insert for resiliently snapping into engagement with the recess means when the insert is inserted fully into the casing.

14. A plug as claimed in claim 7, wherein the internal cross-section of the opening in the casing and the external cross-section of the insert have the same non-circular shape selected to ensure that the terminals of the terminal fitting are received in the apertures in the insert when the insert is inserted into the casing.

15. A dual-standard electrical plug comprising:

an insulating hollow casing having an opening, a terminal fitting within the casing, said fitting comprising a pair of conducting terminal pins extending towards the opening in the casing, an insulating insert insertable with a sliding action into the opening in the casing, said insert having apertures for receiving the terminal pins when said insert is received in the opening of the casing, respective pairs of conducting socket pins projecting from opposite faces of the insert, the socket pins of the respective pairs being adapted to differing standards in respect of their dimensions and relative positions, locking means for locking the insert in the casing with only one selected pin of each pair of socket pins projecting therefrom and the other socket pins accommodated in the casing, connection establishing means in said insert for establishing a conductive connection between said selected pins and the terminal pins received in the terminal pin-receiving apertures in the insert only when the insert is inserted into the casing, and further pin means connected to the terminal fitting, said further pin means projecting externally from the casing at a position remote from the insert-receiving opening and being adapted to plug directly into an electrical appliance.

16. A plug as claimed in claim 15, wherein the terminal fitting is connected to the internal wiring of an electrical appliance on which the plug is mounted.

17. A plug as claimed in claim 15, including stop means in the casing for limiting insertion of the insert and defining the fully inserted position thereof.

18. A plug as claimed in claim 17, wherein the locking means comprises recess means in at least one of the casing and the insert, and projecting lip means on at least the other of the casing and insert for resiliently snapping into engagement with the recess means when the insert is inserted fully into the casing.

19. A plug as claimed in claim 15, wherein the internal cross-section of the opening in the casing and the external cross-section of the insert have the same non-circular shape selected to ensure that the terminals of the terminal fitting are received in the apertures in the insert when the insert is inserted into the casing.

* * * * *